US005552599A

United States Patent [19]

Giessmann et al.

[11] Patent Number: 5,552,599

[45] Date of Patent: Sep. 3, 1996

[54] MASS SPECTROMETER HAVING AN ICP SOURCE

[75] Inventors: Ulrich Giessmann, Bremen; Gerhard Jung, Delmenhorst; Curt Brunnée, Ritterhude, all of Germany

[73] Assignee: Finnegan MAT GmbH, Bremen, Germany

[21] Appl. No.: 315,569

[22] Filed: Sep. 30, 1994

[30] Foreign Application Priority Data

Oct. 1, 1993 [DE] Germany ..... 43 33 469.5

[51] Int. Cl.[6] ..... H01J 49/10

[52] U.S. Cl. ..... 250/281; 250/282; 250/295; 250/296

[58] Field of Search ..... 250/281, 282, 250/288, 287, 294, 295, 296

[56] References Cited

U.S. PATENT DOCUMENTS

| | | | |
|---|---|---|---|
| 4,472,631 | 9/1984 | Enke et al. | 250/281 |
| 4,804,838 | 2/1989 | Miseki | 250/281 |
| 5,218,204 | 6/1993 | Honk et al. | 250/281 |
| 5,352,893 | 10/1994 | Freedman | 250/281 |

FOREIGN PATENT DOCUMENTS

| | | |
|---|---|---|
| 995156 | 9/1981 | U.S.S.R. . |
| 723980 | 3/1989 | U.S.S.R. . |
| 8912313 | 12/1989 | WIPO . |
| 9216008 | 9/1992 | WIPO . |

OTHER PUBLICATIONS

Article entitled "The Ion Mass Spectrometer on Giotto", by H. Balsiger et al, J. Phys. E:Sci. Instrum. 20, 1987 S.759–767.

*Primary Examiner*—Jack I. Berman
*Assistant Examiner*—Kiet T. Nguyen
*Attorney, Agent, or Firm*—Flehr, Hohbach, Test, Albritton & Herbert

[57] ABSTRACT

A mass spectrometer includes an inductive coupled plasma source whose flame is near ground potential, an interface, a flight tube, and an analyzer that includes magnetic and electric sectors, and an ion detector, which detector is operated at high voltage for ion acceleration. The magnetic sector includes a magnet and pole pieces that are insulated electrically relative to the flight tube. The pressure within the interface preferably does not exceed $10^{-3}$ mbar. By varying the magnetic field and the acceleration potential, identification of a specified mass over defined time intervals is carried out. The disclosed mass spectrometer provides improved coupling between the plasma ion source and a double-focussing analyzer, while advantageously providing a low voltage regime for the plasma source.

12 Claims, 11 Drawing Sheets

Schematic diagram of ion optics (Schematische Darstellung der ionenoptischen Elemente)

| | |
|---|---|
| $S_1$ = Sampler | 0V |
| $S_2$ = Skimmer | 0V |
| $S_3$ = Slit | -8kV |

$S_3$ = Eintrittsspalt (Endspalt 26)

$L_1, L_2, L_3, L_5, L_6$ = Linsen $L_4, L_7$ = Linsensysteme

| | |
|---|---|
| $L_1$ = Lens | -2kV |
| $L_2$ = Lens | -2kV |
| $L_3$ Lens | -1-2kV |

| | |
|---|---|
| $L_4$ = Lenssystem | -3kV (± 30V) |
| $L_5$ = Lens | -3kV |
| $L_6$ = Lens | -8kV |
| $L_7$ = Lenssystem | -8kV (± 200V) |

Tabelle zur Fig. 3

MASS SPECTROMETER HAVING AN ICP SOURCE

FIELD OF THE INVENTION

The invention relates to a mass spectrometer having a plasma ion source having a plasma generated by a radio frequency discharge, especially having an ICP ion source and having a double-focusing analyser exhibiting a magnetic sector and an electric sector, as well as a device for detecting the ions. Such a device is known for example from U.S. Pat. No. 5,068,534.

BACKGROUND OF THE INVENTION

For use in mass spectrometers, various ion sources can be considered, including inter alia plasma ion sources. A partial range of the latter relates to the ICP ion sources (ICP= Inductive Coupled Plasma), and in addition the MIP ion sources (MIP=Microwave Induced Plasma). In the case of the ICP source, a plasma is usually generated in a space surrounded by a coil, by induction. Such ion sources were in the past coupled with quadrupole analysers. The latter can be built so as to be relatively small and economic. The coupling itself is non-problematic. Both parts (ion source and quadrupole) can be operated at a potential close to ground, since the accelerating voltage required for the quadrupole is at all events in the region of a few tens of volts. No particular insulating measures are required for the specimen supply to the ICP source.

Double-focusing mass analysers were in the past coupled with various ion sources. In this case, the analyser itself was grounded. To achieve an adequate acceleration of the ions, the ion source itself was set to high voltage. This is the conventional arrangement of an ion source in a mass spectrometer having at least one magnetic sector field.

In the device known from U.S. Pat. No. 5,068,534, an ICP source is coupled with a double-focussing mass analyser operating in the conventional mode of operation. The entrance region of the analyser is, together with the plasma, at high voltage. In order to avoid breakdowns and voltages which are hazardous to the user, the induction coil of the ICP source is screened off in relation to the plasma by a special insulation. Overall, however, the high voltage existing in the region of the ICP source remains problematic for handling.

The object of the present invention is to improve the coupling, known per se, between a plasma ion source and a double-focussing mass analyser, especially to limit the voltages occurring in the region of the source.

SUMMARY OF THE INVENTION

According to the invention, the object is achieved in that the plasma or the flame of the plasma ion source is grounded or is at an electrical potential close to ground and in that, in contrast to this, the analyser is at a positive or negative potential which is sufficiently large to accelerate the ions. A negative potential is usually required for positive ions. In the case of negative ions, naturally, a positive potential can be provided. By the proposed solution, the invention departs from the previously followed line of development, namely the conventional potential arrangement in the case of the mass analyser and the ICP source which is associated therewith and which is subjected to voltage. Instead of exploring further measures for the improved voltage transition in the region of the source, the invention permits, in a surprisingly simple manner, the use of a customary ICP source without additional measures in this region.

The magnetic sector field exhibits in a manner known per se pole pieces, between which a flight tube which is curved in accordance with the ion trajectory is disposed. Advantageously, the flight tube is now at a high negative or positive potential, while the magnet is grounded and the pole pieces are electrically insulated in relation to the flight tube or the magnet. The analyser is aligned for the attainment of a particularly high resolving power with a high sensitivity at the same time. The described electrical arrangement is particularly favourable for this. Usually, the measurements using such analysers are made in a fast scan mode. The described electrical arrangement is also of particular advantage for this purpose.

A further concept of the invention is concerned with the construction of the interface disposed ahead of the analyser, as means for ion acceleration and ion focusing. Within the interface, parts acted upon by the highest positive or negative potential lie in regions of extremely low pressure, especially at $10^{-3}$ mbar or less. Usually, normal atmospheric pressure is present in the region of the plasma flame. The application of a high voltage close to this region, for example close to a sampler of the interface, which sampler faces towards the plasma flame, would lead to undesired discharges. According to the invention, it is provided that voltage gradations provided in the interface are coordinated with likewise provided pressure stages. This means that the pressures in the individual stages are selected so that in accordance with the voltage of the circumjacent parts voltage-induced breakdowns are ruled out.

BRIEF DESCRIPTION OF THE DRAWINGS

Further features of the invention are evident from the claims as well as the remainder of the specification. In the text which follows, details of the invention are explained in greater detail with reference to drawings. In the drawings:

DETAILED DESCRIPTION OF THE PREFERRED EMBODIMENTS

Figure 1:
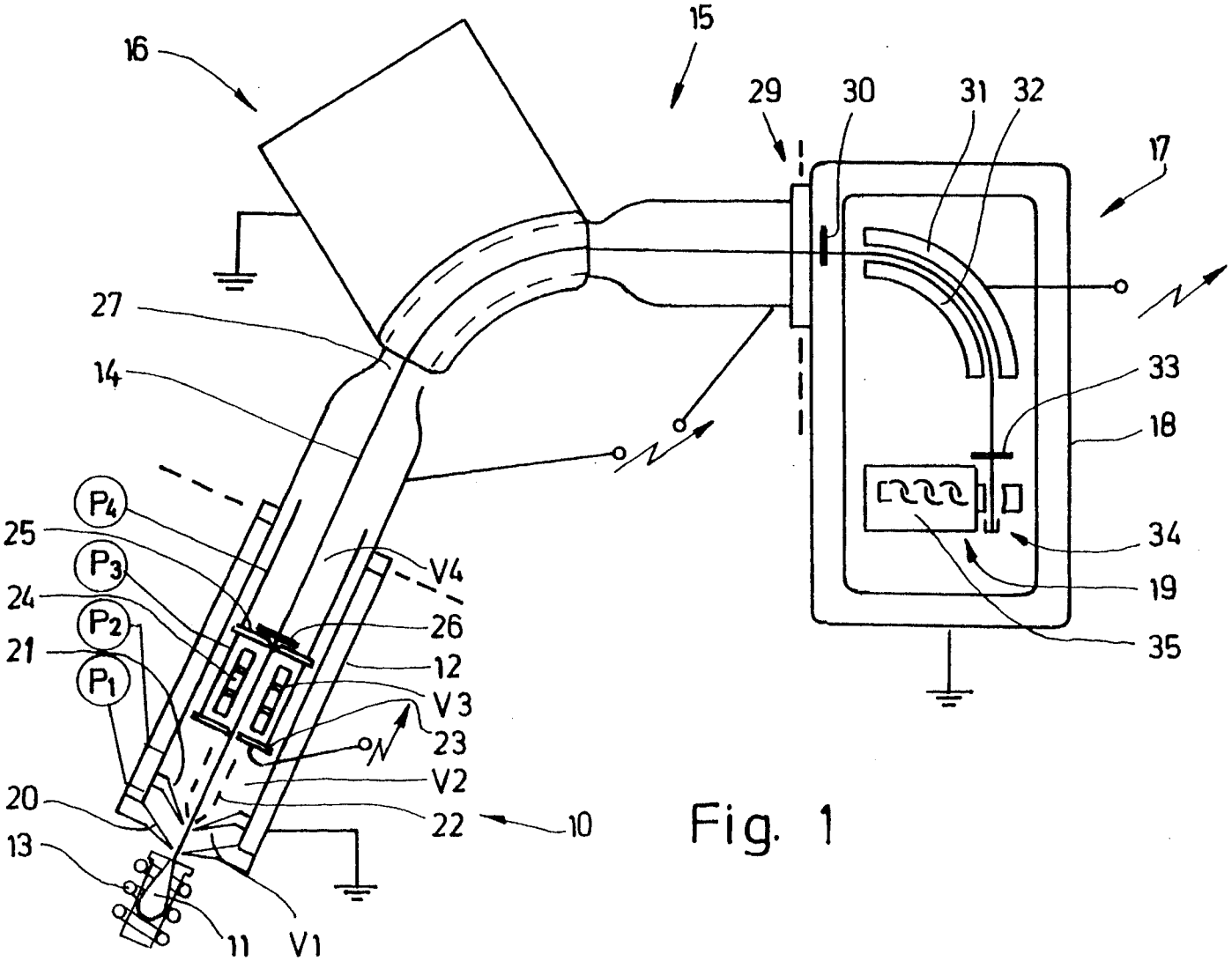
FIG. 1 shows a diagrammatic plan view of a mass spectrometer with ICP ion source or flame, interface, magnetic sector, electric sector and ion detector.

To generate the ions to be analysed, an ion source 10, operating according to the principle of the inductive coupled plasma (ICP), with an ICP flame 11 and an interface 12 disposed to follow the latter is provided. The ICP flame is generated and controlled by an appropriate coil 13. The ion trajectory is designated by the numeral 14.

Disposed to follow the interface 12 there is a device for separating the ions, an analyser 15 with a magnetic sector 16 and an electric sector 17. The latter is surrounded by a housing 18, in which a device for detecting the ions, an ion detector 19 is also disposed.

In the interface 12 there are disposed in succession in the direction of the ion trajectory a sampler 20, a skimmer 21, a lens arrangement 22, a diaphragm 23, a lens system 24, a further diaphragm 25 and an end slit 26. Sampler 20, skimmer 21, diaphragm 23 and diaphragm 25 define in each instance limits between individual pressure stages, to which corresponding vacuum pumps P1, P2, P3 and P4 are allocated or are connected to the same. In this case, the pressure stage with the pump P4 lies, in the direction of the ion trajectory, after the diaphragm 25, at least after the end slit 26.

A flight tube 27 emerges from the interface 12. In this flight tube, the same pressure prevails as in the region connected to the pump P4 in the interface 12. Usually, the flight tube forms the spatial limitation of the ion beam.

The flight tube 27 extends through the magnetic sector 16 and is in this region provided with a reduced cross-section and is electrically insulated in relation to the pole pieces, which are not visible in the figure. To this end, an insulating foil which is suitable for this purpose is provided, e.g. a Kapton foil having a thickness of 75 μm.

The flight tube 27 is connected to the housing 18. At the entrance region 29, a diaphragm 30 or a narrow entrance slit for the ion trajectory is provided. This extends in the electric sector 17 between two jaws 31, 32 defining an electric field. Finally, the ion trajectory passes through a further slit 33 and then impinges on an ion trap 34, especially a conversion dynode with an associated electron multiplier 35.

The described arrangement of the electric sector 17 after the magnetic sector 16 can also be exchanged. The ion detector 19 is then disposed in its own (not shown) housing after the magnetic sector 16.

In order to avoid voltage-induced electrical breakdowns or electrical discharges in the interface 12, the pressures set by the pumps P1, P2, P3, P4 as well as the voltages applied to the sampler 20, the skimmer 21 and the diaphragms 23, 25 as well as the shaping of the components acted upon by voltage are coordinated with one another. While the ICP flame 11 is maintained at atmospheric pressure, the pressure in the vacuum stage V1 allocated to the pump P1, that is to say between sampler 20 and skimmer 21, is approximately 1 mbar. Accordingly, the pressures in the stages V2, V3 and V4 are approximately $10^{-3}$ mbar, $10^{-5}$ mbar and $10^{-7}$ bar. The last-mentioned pressure thus also prevails in the flight tube 27 and in the housing of the electric sector 17.

Figures 2, 2A:
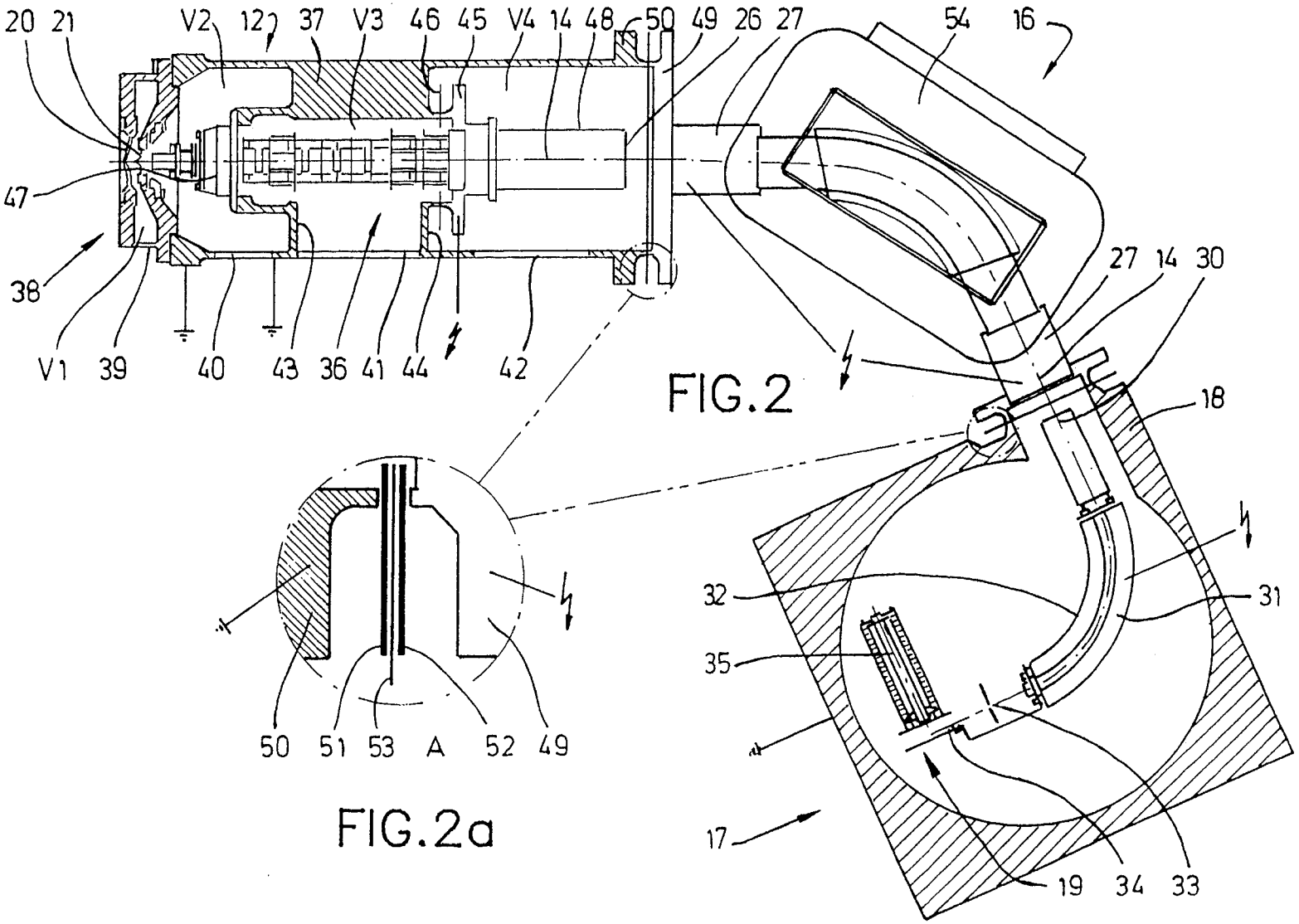
FIG. 2 shows a representation similar to FIG. 1 with a more detailed illustration of the interface or the ion optical system belonging thereto as well as the electrical insulation.
FIG. 2*a* is an enlarged view of portions of FIG. 2.

With the exception of the hereinbelow described deviations, the embodiment according to FIG. 2 corresponds to that in FIG. 1. Just as in FIG. 1, there is disposed ahead of the sampler 20 in FIG. 2 a (not shown) plasma source, especially according to the ICP principle with a corresponding ICP flame. The interface 12 exhibits a housing 37 to receive the ion optical system 36 and to form the individual vacuum stages or pressure stages V1, V2, V3 and V4. Appropriate means for electrical insulation and for sealing off are provided in the housing 37.

The housing 37 is itself grounded, just like the sampler 20 and skimmer 21 enclosing between them a housing head 38 and the first pressure stage V1. In FIG. 2, an opening 39 for a connecting line of the pump P1 (FIG. 1) is shown at the bottom at the head 38. Corresponding openings 40, 41, 42 for connection of the pumps P2, P3, P4 and for the evacuation of the pressure stages V2, V3 and V4 are represented to the right of the opening 39.

In the interior of the housing 37 there are disposed, at a spacing from one another, two housing flanges 43, 44, between which the pressure stage V3 lies, in which the ion optical system 36 is also disposed. The latter is held by an optical system flange 45 connected to the flange 44. To this end, a screw connection (not shown) can be provided. The flanges 44, 45 are insulated in relation to one another by a thin foil 46. A similar, but not shown insulation is provided between the flange 43 and a head 47 of the ion optical system 36. As a result of this, the individual ion-optical components can be acted upon by high voltage, without the housing 37 itself being subjected to voltage.

At the flange 45, beside the mounting for the ion optical system 36 there is disposed, projecting to the right into the space of the pressure stage V4, a tubular screening 48, which ends at a spacing ahead of an end flange 49 at the transition to the flight tube 27. End flange 49 and flight tube 27 are at high voltage and are appropriately electrically insulated in relation to a neighbouring housing flange 50 and moreover sealed off against the entry of air. The special sealing off is represented on an enlarged scale in the detailed drawing FIG. 2*a* of FIG. 2. Directly at the flanges 50, 49 there abut circulating vacuum seals 51, 52, between which again a thin foil 53 for electrical insulation is clamped. To the extent that hitherto and in the text which follows thin foils are provided as insulations, Kapton foils can for example be used. Naturally, other thin insulating materials are also possible.

The same type of insulation or vacuum sealing off is provided between the magnetic sector and the electric sector, more precisely at the entrance of the flight tube 27 into the housing 18 of the electric sector 17.

The electrical insulation in the region of the magnetic sector 16 is explained in greater detail herein-below with reference to FIGS. 4*a* to 4*e*. In the region of the electric sector 17, the housing 18 is grounded and the contents of the same, that is to say the jaws 31, 32, the slit 33 and the ion detector 19, are at high voltage.

Figure 3:
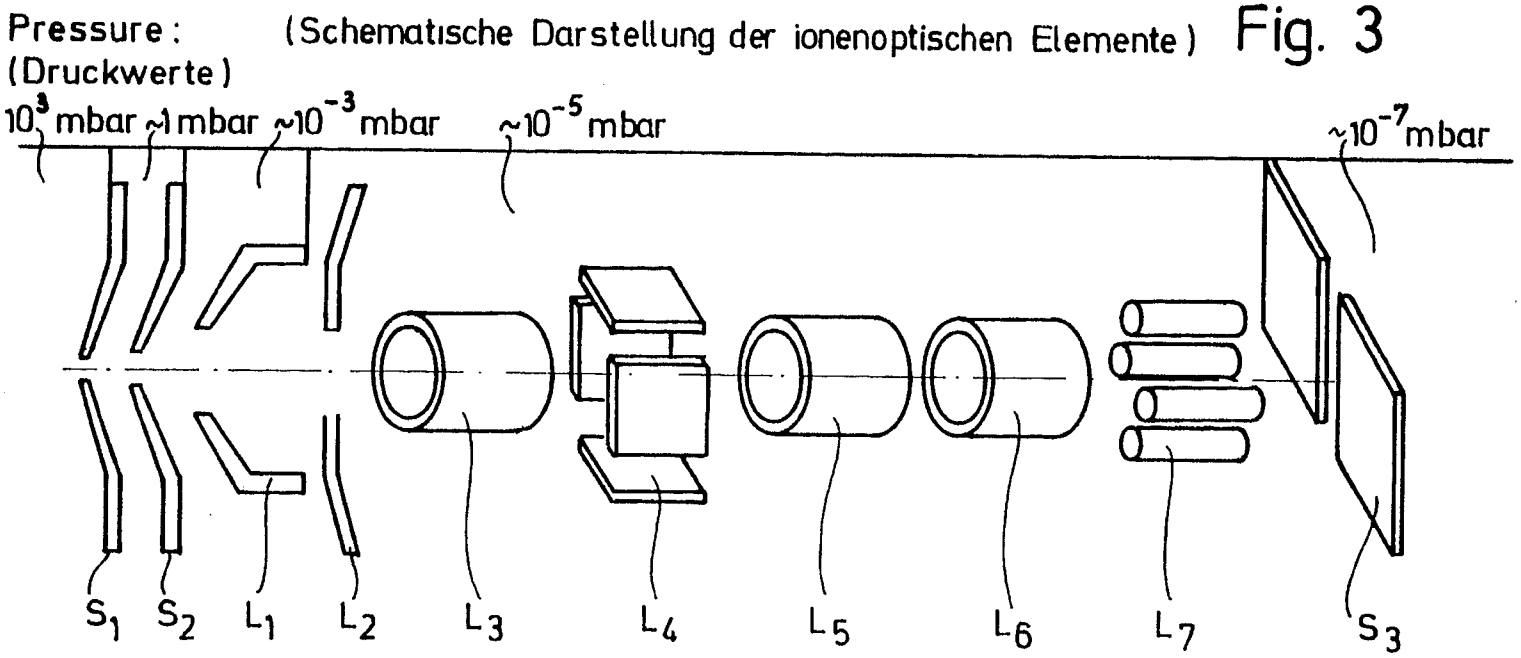
FIG. 3 shows a diagrammatic representation of the ion optical system from a sampler to an end slit or to the entrance slit of the magnetic sector.

In FIG. 3 the individual components of the ion optical system 36 are represented in diagrammatic form and in an exploded view, as are the pressure conditions effective along the ion optical system and, in conjunction with the table associated with FIG. 3, the pertinent voltages as well. To the left of the sampler 20 (S1) atmospheric pressure prevails, to the right thereof as far as the skimmer 21 (S2) approximately 1 mbar. Sampler and skimmer are at 0 V. Between the skimmer and a first lens L1—in the head 47—approximately $10^{-3}$ mbar prevails (pressure stage V2). The remaining ion-optical components L2 to L7 are all part of the ion optical system 36, disposed in the region of the pressure stage V3 and acted upon by the voltages according to the table. The entrance slit 26 (S3) is disposed within the screening tube 48 or at its end and at the same time forms the boundary to the last pressure stage V4 ($10^{-7}$ mbar). The end slit 26 is acted upon by the full high voltage, in this case −8 kV.

Various possibilities of the electrical insulation between the flight tube 27 and an electromagnet 54 of the magnetic sector 16 are represented in FIGS. 4*a* to 4*e*. The magnet 54 exhibits a coil 55 and pole pieces 56, 57. According to FIG. 4*a*, the magnet 54 with the pole pieces 56, 57 is grounded.

The flight tube 27 is at high voltage and is at the same time vacuum chamber for the ion beam. In each instance foils 58 are disposed between flight tube 27 and the pole pieces 56, 57 for insulation. To adjust the magnetic field relative to the ion beam, the magnet including the pole pieces is displaced relative to the flight tube 27 (vacuum chamber).

Figure 4A:
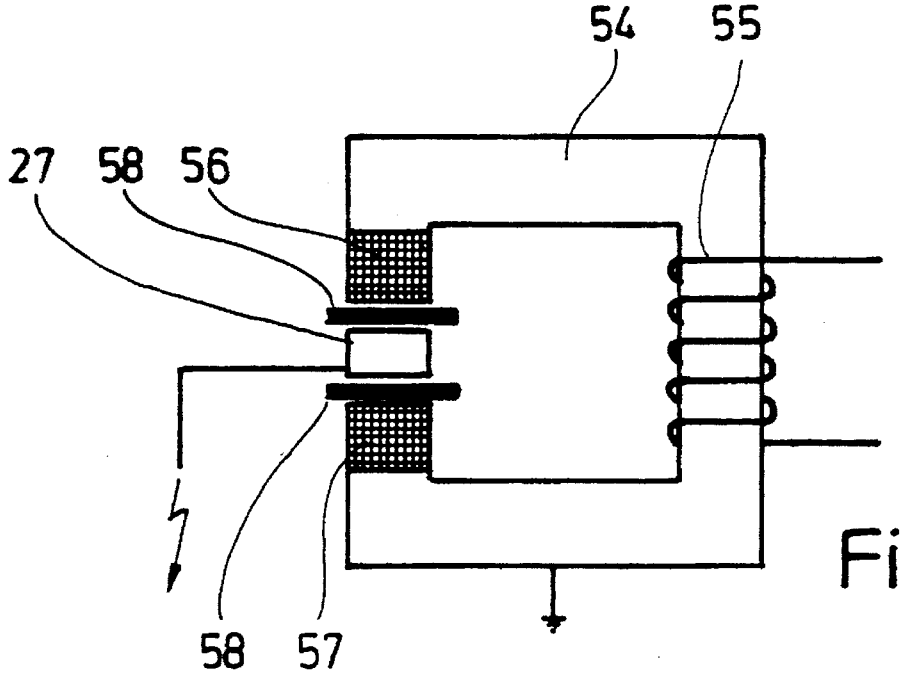
FIGS. 4*a* to 4*e* show cross-sectional representations of various technical solutions of the electrical insulation between flight tube and electromagnet (magnetic sector)
Figure 4B:
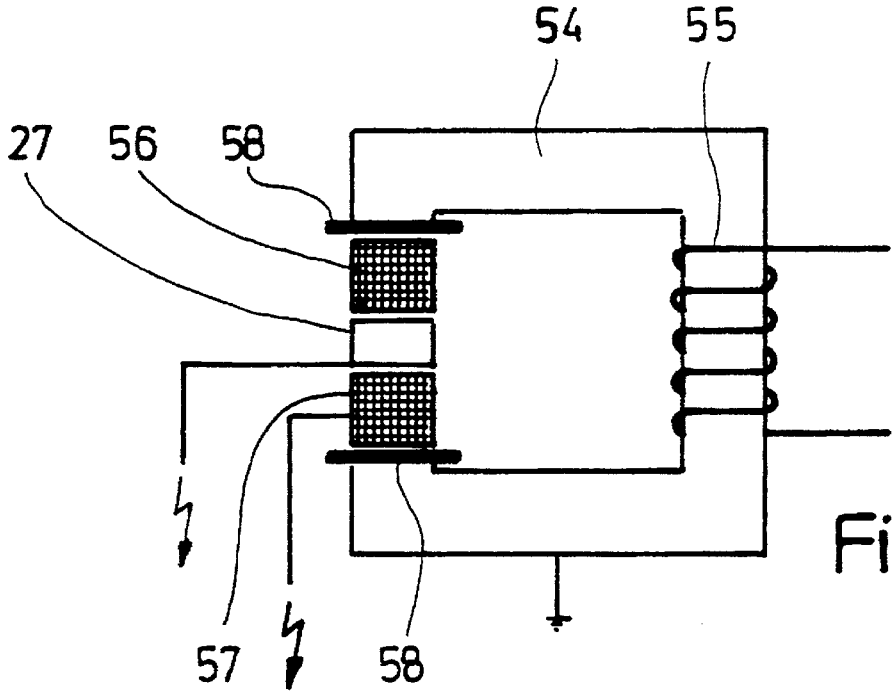

In the embodiment according to FIG. 4*b*, the magnet 54 is actually grounded, but not the pole pieces 56, 57. These are, rather, at the same high potential as the flight tube 27 (at the same time vacuum chamber). Correspondingly, in each instance an insulation 58 is disposed between the pole pieces and the magnet.

Figure 4C:
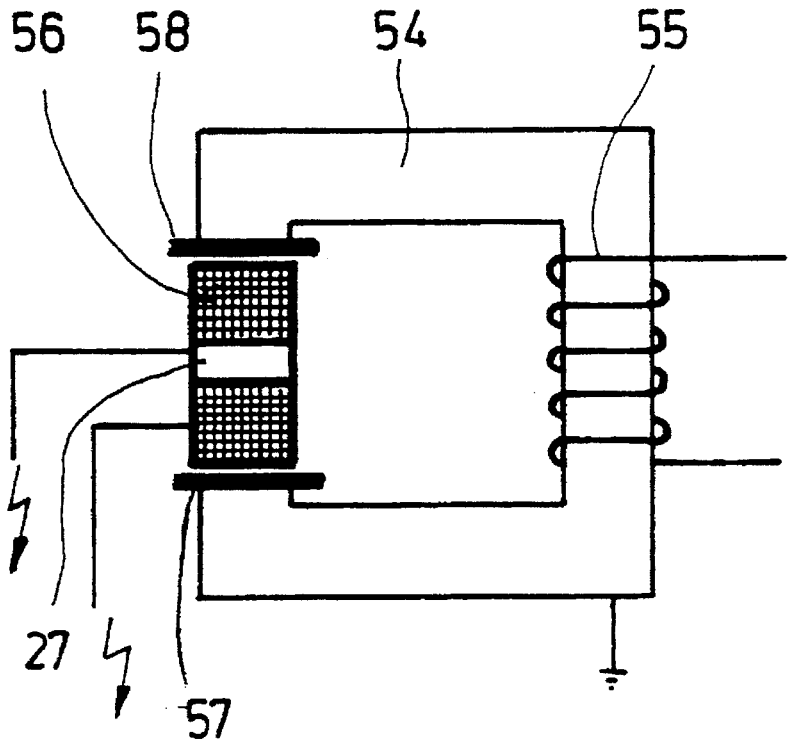

Another particular feature is shown in FIG. 4*c*. In that case, the pole pieces 56, 57 are in the vacuum, that is to say disposed within the flight tube 27. The latter is designed to be correspondingly higher in this region. The magnet 54 is again grounded, with insulations 58 in relation to the flight tube 27 and thus also in relation to the pole pieces 56, 57. The particular advantage of this embodiment resides in that the air gap between the pole pieces is enlarged by twice the wall thickness of the flight tube 27.

Figure 4D:
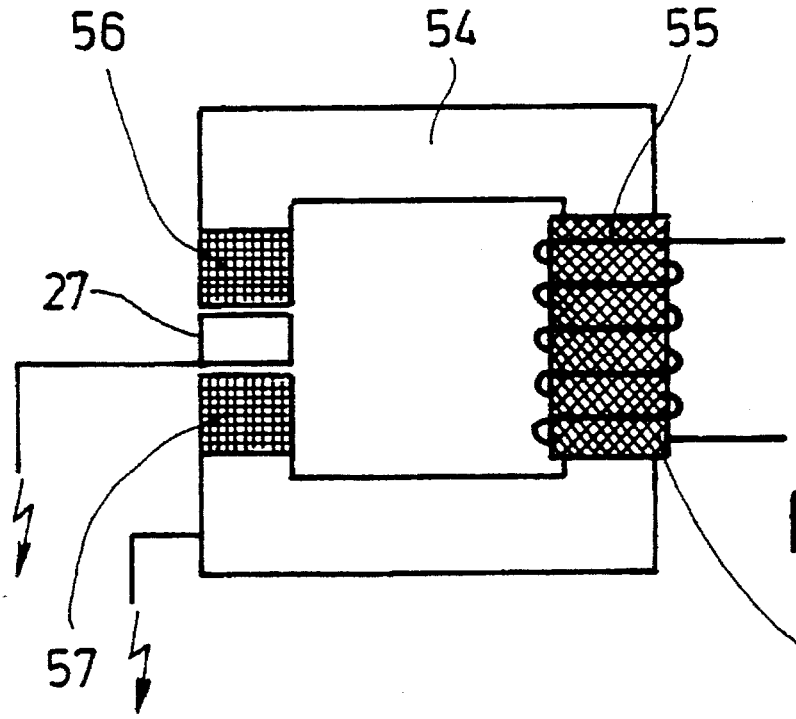

Another solution is shown in FIG. 4*d*. In that case, the magnet 54 with pole pieces 56, 57 and the flight tube 27 is set at high voltage. However, there is in existence an insulation 58 between the coil 55 and the iron core of the magnet 54.

Figure 4E:
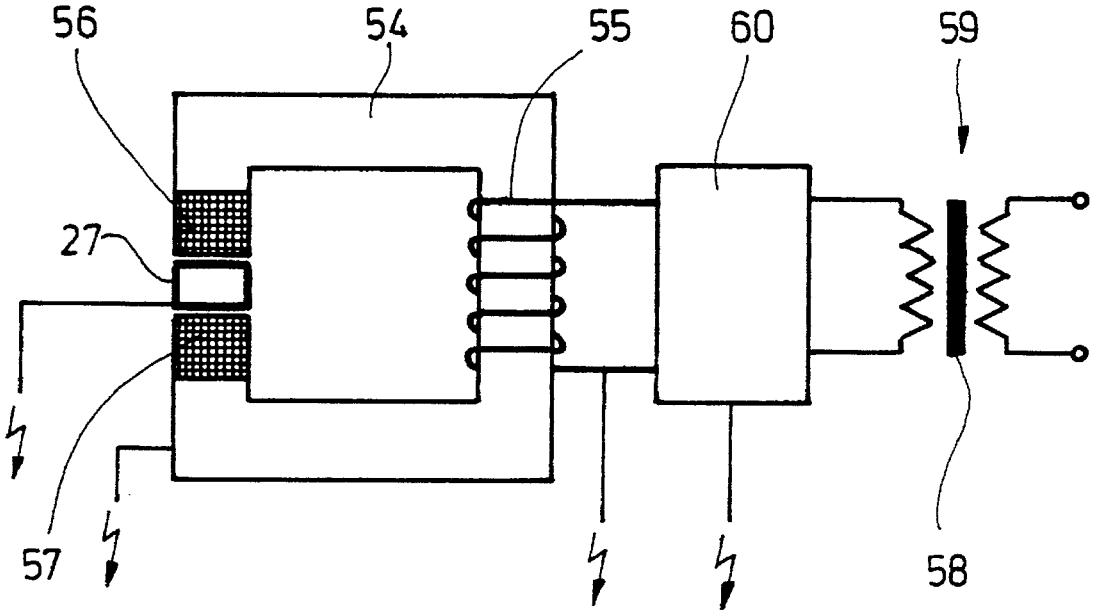

Finally, FIG. 4*e* shows an overall elevated magnet 54, including the coil 55. The insulation takes place here via an isolating transformer 59. A regulator 60 associated with the magnet 54 is likewise at high voltage.

The mass spectrometer is as such double-focussing, and, as previously described, set at high voltage in the region of the ion optical system 36, of the magnetic sector 16 and of the electric sector 17. Only sampler 20 and skimmer 21 are grounded which inherently grounds the plasma or the flame 11. This is because the plasma is highly conductive once it is near atmospheric pressure as discussed above. This potential arrangement gives substantial advantages in a plurality of regions. The sampler 20 is usually provided with a water cooling which is not shown in greater detail. In the prior art, this part is under high voltage. The water circuit must be insulated in correspondingly costly fashion. It is necessary to use multi-deionized water. In the case of the arrangement according to the invention, such measures are not necessary.

The plasma source likewise is overall not under high voltage in the case of the arrangement according to the invention. As a result of this, it is possible to use differing plasma sources without relatively extensive modifications in conjunction with the interface 12. There is no longer any dependence upon plasma sources which are specifically adapted in terms of voltage. Specifically in this region, a high degree of shock-proofness is achieved by the described grounding. In a similar way, this applies to the pumps P1, P2, P3 and P4 connected to the housing 37. In the embodiment according to the invention, these are grounded and thus not insulated in relation to the housing 37.

The high voltage is approximately −8 kV (for positive ions) and is present in its full extent at the latest at the lens L6 (FIG. 3). The lenses or respectively lens systems L1 to L5 disposed ahead in each instance are at somewhat lower potentials of −1 kV to −3 kV. The larger voltage transitions, namely between 0 and −2 kV and −3 kV to −8 kV, lie in each instance in the vacuum, namely in the pressure stage V2 and the pressure stage V3 respectively. On account of the vacuum, electrical breakdowns or discharges in this region are ruled out.

Figure 5:
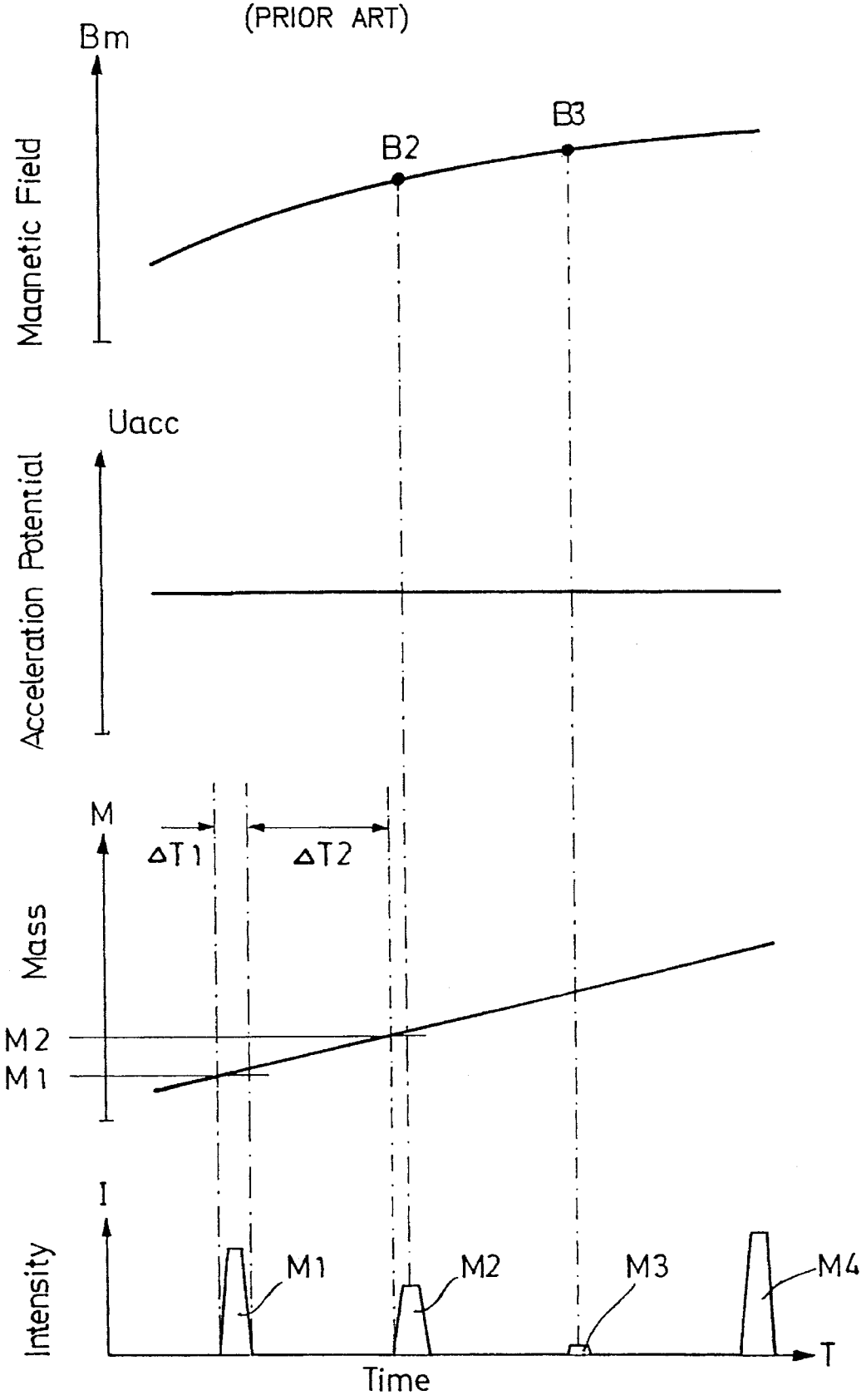
Fig. 5 (PRIOR ART)
FIG. 5 shows a graphical representation of specified quantities against a time axis in a customary mode of operation of a double-focussing mass spectrometer.

The described mass spectrometer is prepared for a particular mode of operation. Specifically, the magnetic field of the magnetic sector 16 and at the same time the overall prevailing accelerating voltage are varied in a manner coordinated with one another. A synchronization of the two quantities is present. In the first instance, the prior art is described with reference to FIG. 5. The further FIGS. 6 to 9 in turn concern the invention. In the first instance, concerning the prior art (FIG. 5):

Usually, in the case of double-focusing sector field mass spectrometers in the course of the recording of a spectrum the magnetic field is scanned in accordance with a prescribed time function, for example magnetic field $B_m = ae^{bT}$. In FIG. 5, by way of example using an appropriate curve, the magnetic field $B_m$ is plotted against the time T. Below this, the accelerating voltage $U_{acc}$ is plotted as a constant. The ions of a prescribed mass/charge ratio can thus reach the detector only within a narrow time window in accordance with the alteration of the magnetic field. As soon as the mentioned time window is left by the scan of the magnetic field, there are no longer in existence any stable trajectories for these ions within the analyser. Thus, ions of mass M1 are registered only within the time window ΔT1. In the time interval ΔT2 adjacent to this, no registration takes place, but only again in the case of the adjacent mass M2. In FIG. 5, in the lower region in the first instance the mass and, therebelow, the registered intensity are plotted against the time. Only upon reaching B2 are ions again registered, namely those of mass M2, correspondingly in the case of B3 ions of mass M3 etc. Since the determinable masses (mass/charge ratio) do not adjoin one another with any selectable closeness, there are always time intervals present which are unused for the measurement, similar to ΔT2. This applies especially in the case of the analysis of smaller masses, for example within the range of 50 Dalton. The time between two adjacent masses, in FIG. 5 the time ΔT2 between M1 and M2, remains unused in metrological terms.

Figure 6:
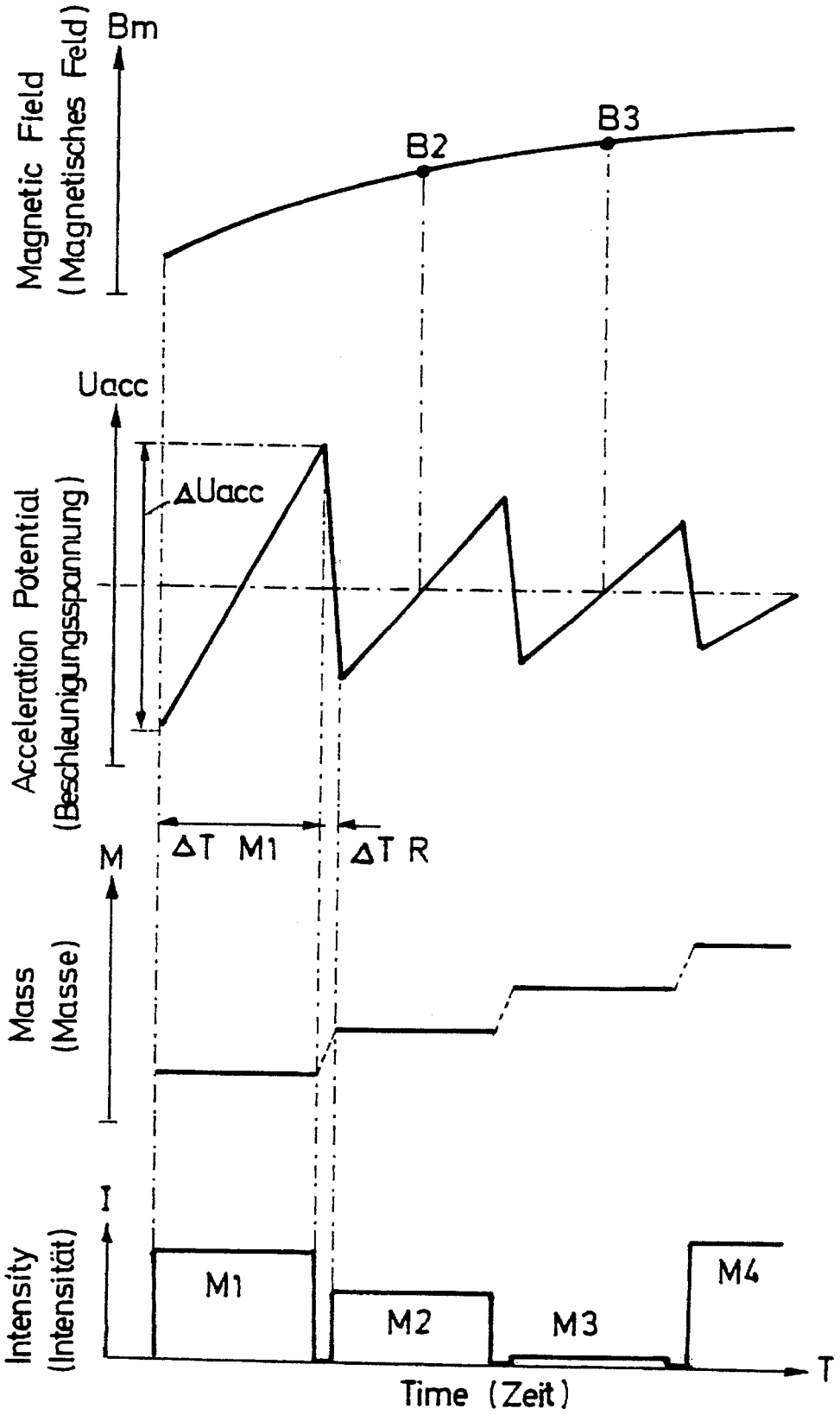
FIG. 6 shows a graphical representation according to FIG. 5, but for a new mode of operation.

In contrast to the prior art, FIG. 6 shows the novel type of scan which is provided in the case of the mass spectrometer according to the invention. The breakdown of the diagrams corresponds to that in FIG. 5. The magnetic field $B_m$ is slowly and steadily altered (scanned) in accordance with a prescribed time function. In contrast to the prior art, the accelerating voltage does not remain constant, but is synchronized with the magnetic field, and specifically with respect to the masses (mass/charge ratio) to be detected. The alteration of the accelerating voltage $U_{acc}$ takes place so that the effect of the alteration of the magnetic field is compensated and the mass spectrometer detects the mass M1, in total, for a time interval $\Delta T_{M1}$. In this time $\Delta T_{M1}$, the known trajectory equation $B_m/U_{acc}^{1/2}$=constant is applicable. After expiry of the time ΔT1, the accelerating voltage is reduced in the manner of a jump, in a very short time ΔTR, to a low value. From there, a rise of $U_{acc}$ again takes place for synchronization with the magnetic field. The result is that in each instance a substantially broader time interval is available for the detection of the individual masses. The sensitivity of the mass spectrometer is improved by more than one order of magnitude.

The accelerating voltage is altered for example by approximately 200 V (minimum to maximum), that is to say that a fluctuation of approximately ±100 V takes place about the highest potential −8 kV represented in the table relating to FIG. 3. Depending upon the mass to be detected, naturally, other potential alterations are possible and provided. In principle, the applied voltages are not altered by the same fixed amount, but are in each instance acted upon by the same factor, so that the relative alteration of the voltage is the same. The voltage alteration is undertaken on all components which are under voltage and influence the ion trajectory.

Figure 7:
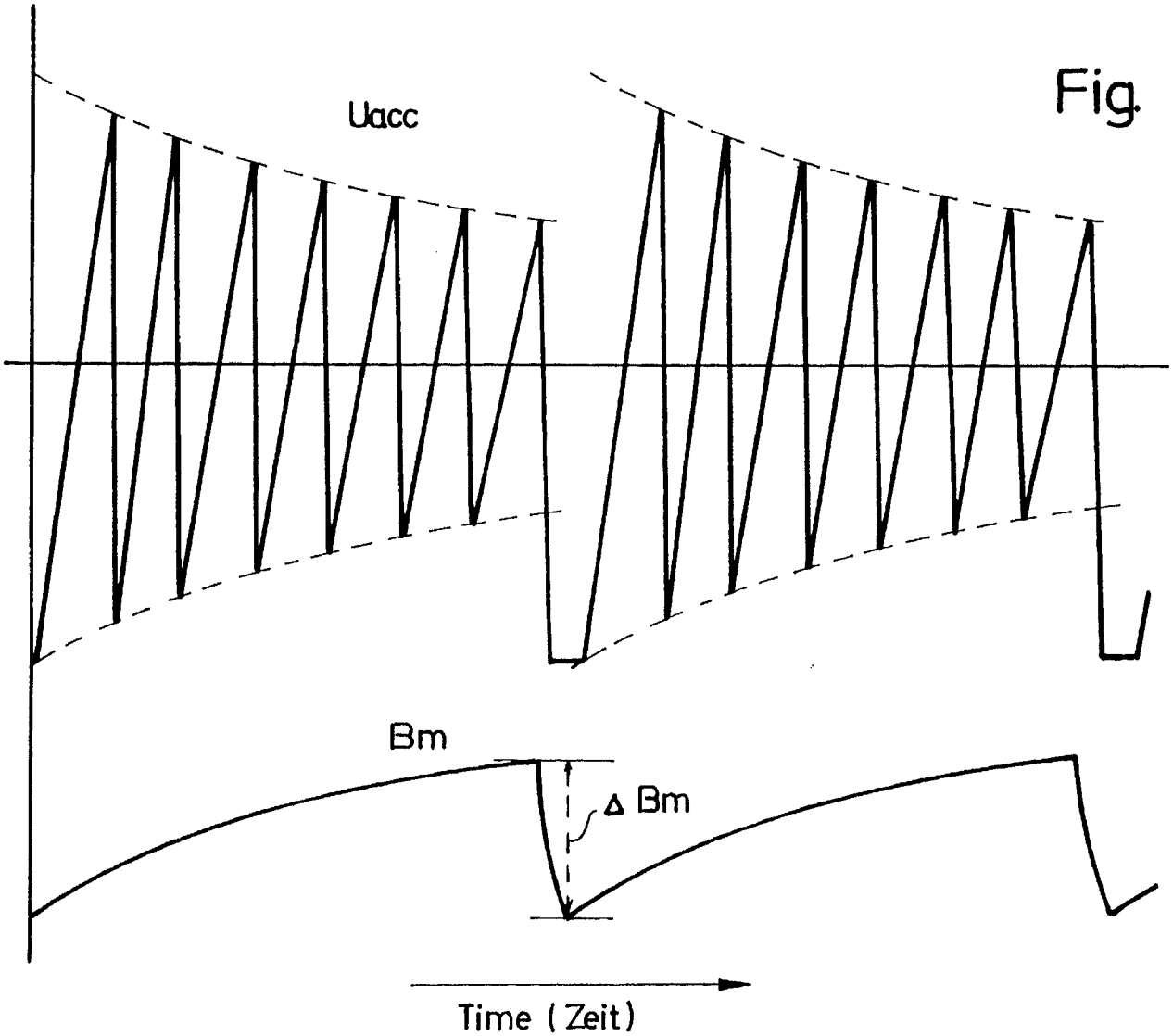
FIG. 7 shows a graphical representation of the accelerating voltage and of the magnetic field according to FIG. 6, but considered over a longer period of time.

FIG. 7 shows once again the magnetic field (bottom) and the accelerating voltage (top) in time-lapse sequence. During a scan of the magnetic field, that is to say during a rise from minimum to maximum, a plurality of sawtooth-type scans (of each respective mass to be detected) of the accelerating voltage are carried out. As the mass increases, the maximum differences of the accelerating voltage become smaller. In FIG. 7, the converging envelope curves which are obtained are shown in broken lines. On account of the long time constant of the magnetic field, the jump back by the value $\Delta B_m$ takes place in a somewhat longer time, relative to the remaining time, than as shown in FIG. 7. By way of a deviation from the representations, the magnetic field can also be scanned downwards. The described repetition of the individual scans is designated as repeating mode of operation.

Figure 8:
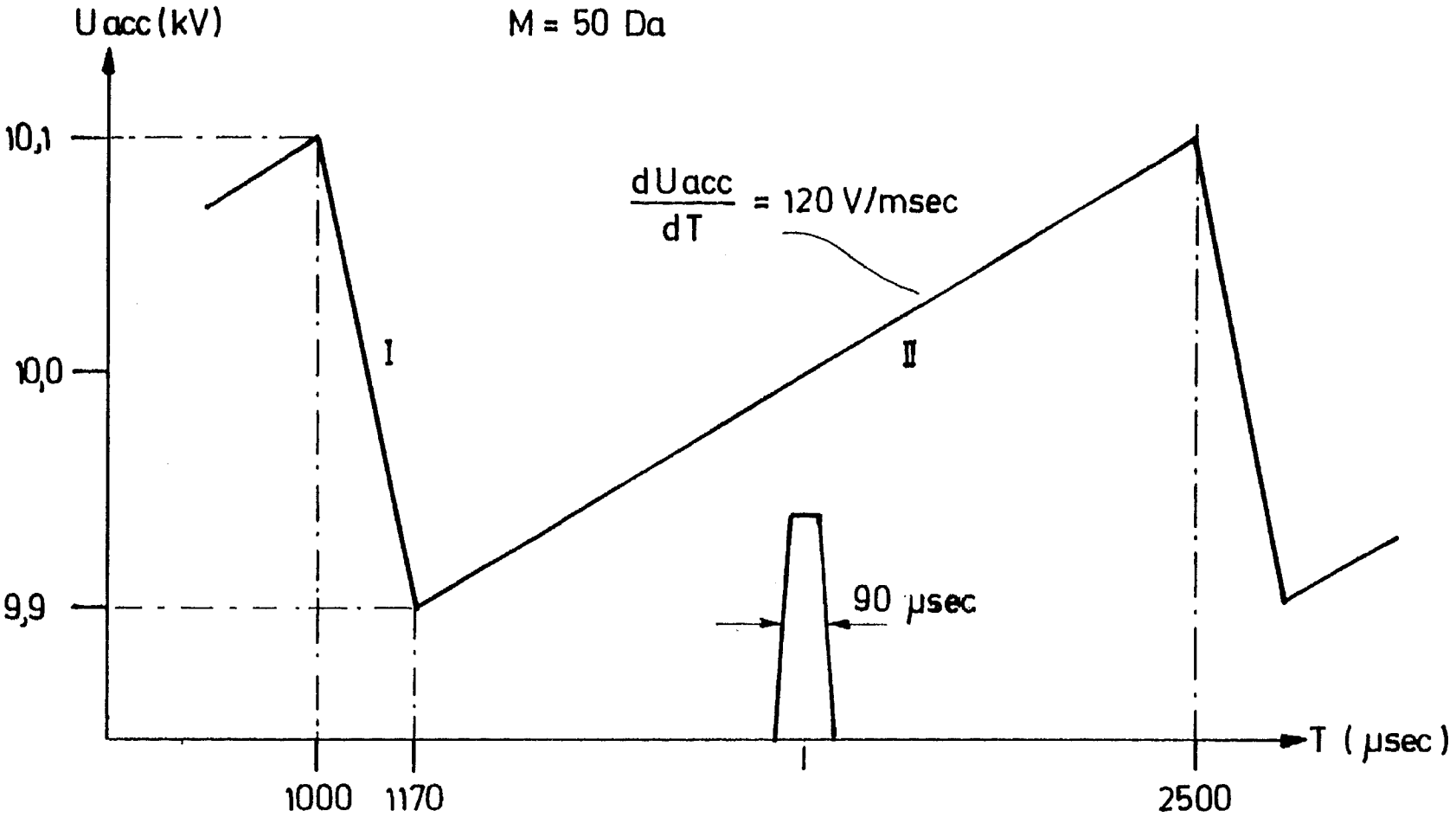
FIG. 8 shows a graphical representation of the accelerating voltage for a very short period of time.

FIG. 8 shows once again the alteration of the accelerating voltage with reference to specific numerical values. The starting point is a mass to be detected of M=50 Da. Previously, lower masses have already been detected. In phase I, the accelerating voltage is lowered by 200 V within 170 μsec. The "standard value" of the potential is, in this example, at 10 kV. While the magnetic field rises further continuously, in phase II the accelerating voltage follows at approximately 120 V/msec. During a time interval of 1.33 msec, in this case the ion mass 50 Da is registered at the detector. In the customary mode of operation ($U_{acc}$=constant) the ion signal would be registerable only for approximately 90 μsec with a mass resolution of $M/\Delta M$ =500 and with the same scan speed of the magnetic field. The mentioned short time interval is also shown in FIG. 8. The time interval which is in contrast greater extends from T=1170 to T=2500.

Figure 9:
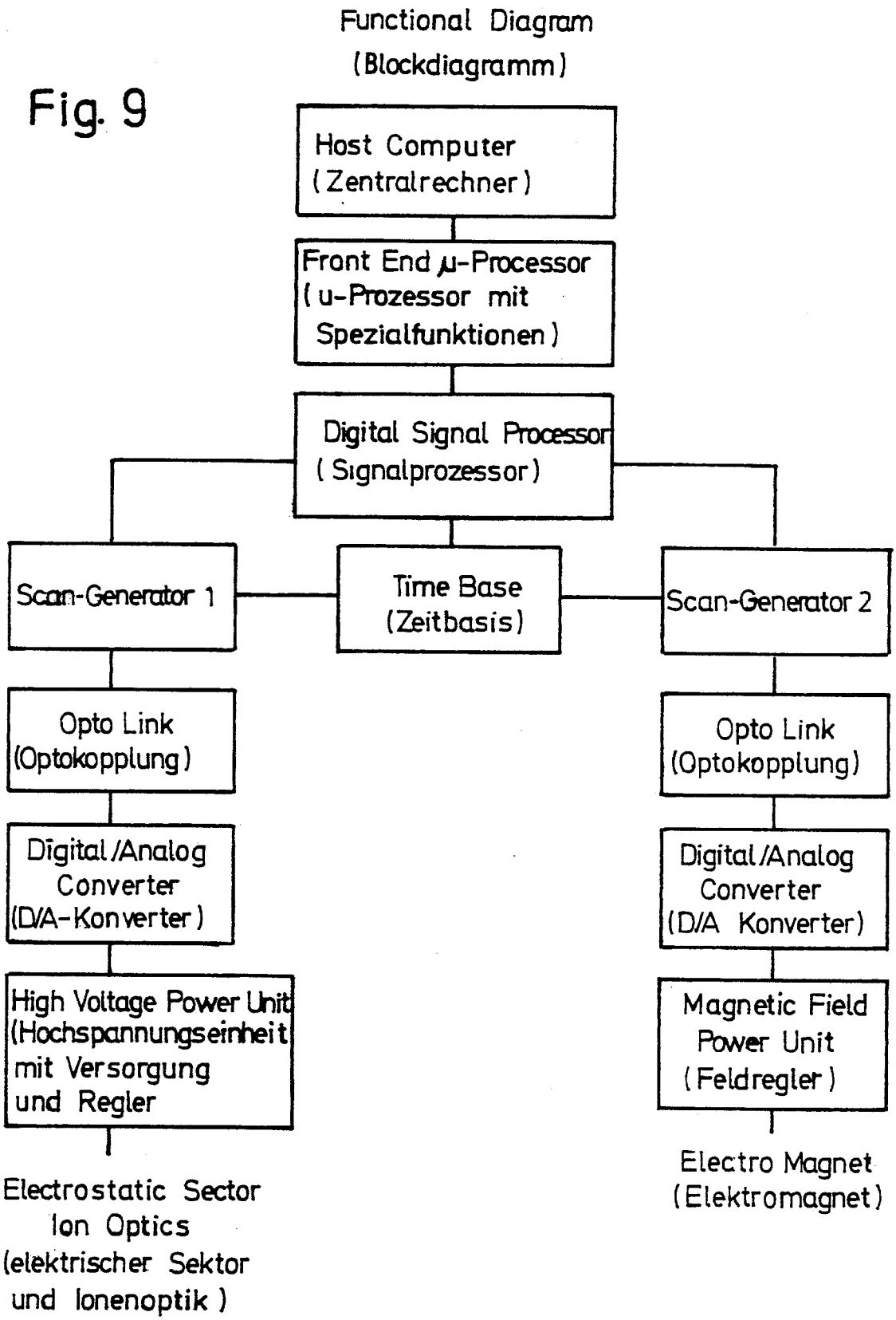
FIG. 9 shows a block diagram to explain the new mode of operation.

Finally, FIG. 9 shows the cooperation of various electronic assemblies to realize the described synchronous mode of operation. Via the host computer, a scan function stored in the (front end) μ processor is parametrized and activated. Via a central digital signal processor, the two scan generators 1 and 2, which govern the temporal progression of the accelerating voltage and of the magnetic field, are driven. Signal processor and also both scan generators are synchronously clocked via the time base. In galvanically decoupled fashion, the digital control pulses are passed via optocouplers to D/A converters; subsequently, in the high voltage unit the required accelerating voltage is generated, and, respectively, in the field regulator the corresponding magnetic flux is generated. The principle of the digital control of the voltage and respectively of the magnetic field is known in mass spectrometry and therefore does not need to be explained in greater detail here.

The described mass spectrometer with the analyser which is at high voltage is particularly advantageous for the proposed synchronized mode of operation. The voltage of the components which are correspondingly acted upon is alterable with relatively small time constants. The plasma source itself is not affected by this, since said source is grounded. The situation would be different in the case of a plasma source which is at high potential. Such a source, including the plasma, would then have to be scanned in terms of potential.

The invention is particularly suitable for element analysis, especially multielement analysis, in which the relative mass range to be covered is relatively large. What matters principally is the question of whether and how many masses, known in terms of magnitude, are present in a specimen.

In principle, the described analyser which is at high electrical potential, especially with the interface and the ion optical system, can also be used with other ion sources.

We claim:

1. Mass spectrometer including:

an inductive coupled plasma ion source generating a plasma by a high frequency discharge comprising:

means for grounding said plasma;

a double-focusing analyzer having a magnetic sector including a magnet and an electric sector, and operating at an ion accelerating potential of a chosen polarity of either positive or negative which is sufficiently large to accelerate ions, a flight tube for providing a path for said ions through said magnet, said flight tube being at said potential of chosen polarity;

means for electrically insulating at least a portion of said magnet from said flight tube, and means for detecting said ions.

2. Mass spectrometer according to claim 1 further including a Kapton foil disposed between said at least a portion of said magnet and said flight tube wherein said foil provides electrical insulation.

3. Mass spectrometer according to claim 1, wherein said electric sector includes a housing, and wherein said electric sector is substantially at a high potential and is grounded only by said housing.

4. Mass spectrometer according to claim 1 wherein:

said analyzer includes an interface having means for ion acceleration and ion focusing; and wherein parts acted upon within said interface by a highest potential of either polarity lie in regions of low pressure not exceeding $10^{-3}$ mbar.

5. Mass spectrometer according to claim 4, wherein said flight tube is disposed on an exit side of said interface, and further including:

a sampler disposed on a plasma entrance side of said interface; and a plurality of differential vacuum pumping stages ensuring sufficiently low pressure within said flight tube.

6. Mass spectrometer according to claim 1, wherein:

said magnetic sector has a magnetic field $B_m$;

said ion accelerating potential is $U_{acc}$; and $B_m$ and $U_{acc}$ are coordinately alterable such that a specified mass is detectable for defined time intervals.

7. Mass spectrometer according to claim 1 further including an interface having means for accelerating and focusing said ions positioned upstream of said analyzer and after said ion source, and including a sampler located on a plasma-entry side of the interface, said sampler being grounded whereby said plasma is grounded.

8. Mass spectrometer according to claim 7 further comprising a skimmer arranged downstream of the sampler in the interface in the direction of the ion trajectory, and the skimmer is grounded.

9. Mass spectrometer according to claim 7 characterized in that the plasma is approximately under atmospheric pressure until the ions enter into the sampler.

10. Mass spectrometer according to claim 1 characterized in that the magnetic sector has said magnet which, similar to the flight tube for the ions, has at least a portion at a high negative or positive electrical potential.

11. Method for operating a double-focusing mass spectrometer including the steps of:

providing and coordinately altering a magnetic field $B_m$ and an ion accelerating potential $U_{acc}$ such that a specified mass detected by said spectrometer is a constant for a specified time interval.

12. Method according to claim 11 wherein:

said magnetic field is steadily altered during a scan over a range comprising a plurality of masses; and said accelerating potential is altered in sawtooth fashion in association with alteration of said magnetic field, such that gradually differing specified masses are detectable by said spectrometer in each instance within said specified time interval.

* * * * *